US008188725B2

(12) United States Patent
Draghi et al.

(10) Patent No.: US 8,188,725 B2
(45) Date of Patent: May 29, 2012

(54) VOLTAGE REGULATOR AND METHOD FOR VOLTAGE REGULATION

(75) Inventors: Paolo Draghi, Pavia (IT); Andrea Pierin, Canneto Pavese (IT)

(73) Assignee: austriamicrosystems AG, Unterpremstätten (AT)

( * ) Notice: Subject to any disclaimer, the term of this patent is extended or adjusted under 35 U.S.C. 154(b) by 149 days.

(21) Appl. No.: 12/675,903

(22) PCT Filed: Aug. 25, 2008

(86) PCT No.: PCT/EP2008/061093

§ 371 (c)(1),
(2), (4) Date: Jul. 12, 2010

(87) PCT Pub. No.: WO2009/027375

PCT Pub. Date: Mar. 5, 2009

(65) Prior Publication Data

US 2010/0289468 A1 Nov. 18, 2010

(30) Foreign Application Priority Data

Aug. 30, 2007 (EP) ..... 07017012

(51) Int. Cl.
*G05F 3/16* (2006.01)

(52) U.S. Cl. ..... 323/316; 323/280

(58) Field of Classification Search ..... 323/280, 323/315, 316

See application file for complete search history.

(56) References Cited

U.S. PATENT DOCUMENTS

| | | | | |
|---|---|---|---|---|
| 5,552,697 | A | 9/1996 | Chan | |
| 6,188,212 | B1 | 2/2001 | Larson et al. | |
| 6,300,749 | B1 | 10/2001 | Castelli et al. | |
| 6,683,444 | B2 * | 1/2004 | Marie | 323/314 |
| 6,804,102 | B2 | 10/2004 | Hamon et al. | |
| 2005/0057234 | A1 | 3/2005 | Yang et al. | |

FOREIGN PATENT DOCUMENTS

EP 1 729 197 12/2006

OTHER PUBLICATIONS

G.A. Rincon-Mora et al., "A Low-Voltage, Low Quiescent Current, Low Drop-out Regulator", IEEE Journal of Solid-State Circuits, IEEE Service Center, vol. 33, No. 1, pp. 36-43, Jan. 1998.

S.K. Hoon et al., "A Low Noise, High Power Supply Rejection Low Dropout Regulator for Wireless System-on-Chip Applications", Proceedings of the IEEE Custom Integrated Circuit Conference, CICC '05, San Jose, USA, pp. 759-762, Sep. 2005.

* cited by examiner

*Primary Examiner* — Shawn Riley
(74) *Attorney, Agent, or Firm* — Cozen O'Connor

(57) ABSTRACT

A voltage regulator (10) comprises a first transistor (13) which couples an input terminal (11) of the voltage regulator (10) to an output terminal (12) of the voltage regulator (10) and a second transistor (16). The first and the second transistors (13, 16) form a current mirror structure. Further on, the voltage regulator (10) comprises a control node (17) which is coupled to the input terminal (11) of the voltage regulator (10) via the second transistor (16) and which is coupled to the output terminal (12) of the voltage regulator (10) via a feedback circuit (28). Furthermore, the voltage regulator (10) comprises an amplifier (22) with an input terminal (23) which is coupled to the control node (17) and an output terminal (24) which is coupled to a control terminal (21) of the second transistor (16).

12 Claims, 3 Drawing Sheets

VOLTAGE REGULATOR AND METHOD FOR VOLTAGE REGULATION

RELATED APPLICATIONS

This is a U.S. national stage of application No. PCT/EP2008/061093, filed on Aug. 25, 2008.

This application claims the priority of European application no. 07017012.1 filed Aug. 30, 2007, the entire content of which is hereby incorporated by reference.

FIELD OF THE INVENTION

The present invention relates to a voltage regulator and a method for voltage regulation.

BACKGROUND OF THE INVENTION

For example, a conventional voltage regulator comprises an input terminal to receive a supply voltage, an output terminal to provide an output voltage, and a first transistor which couples the input terminal of the voltage regulator to the output terminal of the voltage regulator. Furthermore, the voltage regulator comprises a second transistor, wherein the first and the second transistors form a current mirror structure. Further on, the voltage regulator comprises a control node which is coupled to the input terminal of the voltage regulator via the second transistor and which is coupled to the output terminal of the voltage regulator via a feedback circuit forming a control loop. The feedback circuit may comprise a feedback amplifier.

A conventional method for voltage regulation comprises supplying a supply voltage to a first and a second current path and providing an output voltage at the first current path. Further on, such method comprises mirroring a first current in the first current path to a second current in the second current path and controlling the second current path depending on the output voltage by a control loop. For example, the second current path is controlled depending on a comparison of a feedback voltage derived from the output voltage to a feedback reference voltage.

Such a voltage regulator is shown for example in "A Low Noise, High Power Supply Rejection Low Dropout Regulator for Wireless System-on-Chip Applications", S. K. Hoon et al., Proceedings of the IEEE Custom Integrated Circuit Conference, CICC05, San Jose, USA, pp. 759-762, September 2005. According to that document, the supply voltage is provided to a first terminal of the first transistor and to a first terminal of the second transistor. A second terminal of the second transistor is connected to the control node. The control node is coupled to a reference potential terminal via a third transistor. Since the control node is directly connected to a control terminal of the first transistor, a disturbance of the supply voltage has an influence on the output voltage. Furthermore, a current which flows through the third transistor also depends on a variation of the supply voltage.

The document "A Low-Voltage, Low Quiescent Current, Low Drop-Out Regulator", G. A. Rincon-Mora, P. Allen, IEEE Journal of Solid-State Circuits, volume 33, no. 1, January 1998, pp. 36-44 shows a further power supply circuit having a first and a second transistor in a mirror configuration.

SUMMARY OF THE INVENTION

This object is solved by the subject matter of the independent claims. Preferred embodiments are presented in the respective dependent claims.

According to an embodiment, the aforementioned voltage regulator further comprises an amplifier with an input terminal and an output terminal. The input terminal of the amplifier is coupled to the control node. The output terminal of the amplifier is coupled to a control terminal of the second transistor.

A supply voltage is received at the input terminal, while an output voltage is provided at the output terminal.

It is an advantage of a voltage regulator with an amplifier between the control node and the control terminal of the second transistor that the amplifier separates a direct current bias point of the control node from a direct current bias point of the control terminal of the second transistor. Thus only the control terminal but not the control node tracks the supply voltage. This results in an influence of the supply voltage on a voltage between the control terminal of the second transistor and the input terminal being reduced and, therefore, a high power supply rejection ratio being achieved.

In an embodiment, the control terminal of the first transistor is directly connected to the control terminal of the second transistor. In addition, the control terminal of the first transistor is directly connected to the output terminal of the amplifier. Thus, the control terminal of the second transistor is also directly connected to the output terminal of the amplifier. Since a first terminal of the first transistor and a first terminal of the second transistor are directly connected to the input terminal, the first and the second transistors form an efficient current mirror.

In a development, the amplifier comprises a further input terminal to which a reference voltage is provided. The further input terminal of the amplifier is connected via a voltage source to a reference potential terminal. The reference voltage is almost independent from the supply voltage. Since the amplifier has a high gain, the voltage at the control node is approximately equal to the reference voltage. Therefore, the voltage at the second terminal of the second transistor does not depend on the supply voltage. Since the voltage at a second terminal of the first transistor is equal to the output voltage, the voltage at the second terminal of the first transistor and the voltage at the second terminal of the second transistor are independent of disturbances or variations of the supply voltage. Thus a very efficient power supply rejection ratio is achieved.

According to an example, the amplifier is implemented as a differential amplifier. The amplifier can comprise a single stage. Alternatively, the amplifier can comprise at least two stages. In an embodiment, the amplifier comprises a class AB output stage. The amplifier is a non-inverting amplifier.

In a development, the amplifier comprises an amplification transistor with a controlled path that couples the input terminal of the amplifier to the output terminal of the amplifier. Thus the amplification transistor connects the control node to the control terminal of the first transistor and to the control terminal of the second transistor. A control terminal of the amplification transistor is coupled to the further input terminal of the amplifier. Moreover, the amplifier comprises a pull up current generator which is connected to the output terminal of the amplifier. Therefore, the reference voltage is applied to the control terminal of the amplification transistor. The amplifier is implemented as a single-stage amplifier. The number of transistors for the realization of the amplifier is advantageously low resulting in an area-saving design of the amplifier on a semiconductor body.

In an alternative development, the amplifier comprises a first and a second amplifier transistor which are connected in series between the input terminal of the voltage regulator and the reference potential terminal. A control terminal of the first amplifier transistor is connected to the control node via the input terminal of the amplifier. A first stage node is arranged between the first and the second amplifier transistors. A control terminal of the second amplifier transistor is connected to the first stage node. The first stage node is coupled to the output terminal of the amplifier. The amplifier additionally comprises a second stage coupling the first node to the output terminal of the amplifier. For the realization of the second stage, the amplifier comprises a current generator and a third amplifier transistor which are connected in series between the input terminal of the voltage regulator and the reference potential terminal. A control terminal of the third amplifier transistor is connected to the first stage node. Thus the second and the third amplifier transistors are arranged in the form of a current mirror. A second stage node is arranged between the current generator and the third amplifier transistor and is connected to the output terminal of the amplifier. According to this embodiment, the amplifier is realized as a single input amplifier. The amplifier comprises two stages. The gain of the amplifier is advantageously increased by the second stage.

In an embodiment, the current generator comprises a current mirror.

The voltage regulator is preferably designed as a linear regulator. According to an embodiment, the voltage regulator is realized as a low-dropout regulator.

According to an embodiment, the aforementioned method for voltage regulation comprises coupling the second current path and the first current path by a further control loop.

It is an advantage of the method for voltage regulation comprising the further control loop that the first current path is very efficiently controlled and a high power supply rejection ratio is achieved.

In an embodiment, a control voltage is provided by the second current path and a control terminal voltage is generated by amplification of the control voltage. The control terminal voltage controls the first current and the second current to implement the further control loop.

In an embodiment, the first current path comprises a first transistor and the second current path comprises a second transistor. A first terminal of the first transistor and a first terminal of the second transistor are directly connected to an input terminal of a voltage regulator at which the supply voltage is provided. A second terminal of the first transistor is connected to an output terminal of the voltage regulator at which the output voltage is provided. The control loop couples the output terminal of the voltage regulator to a control node which is connected to the second terminal of the second transistor. The control voltage is provided at the control node. The control loop can be realized by a feedback circuit. The further control loop couples the control node to a control terminal of the first transistor and to a control terminal of the second transistor. The control terminal voltage is supplied to the control terminal of the first transistor and to the control terminal of the second transistor. The further control loop comprises an amplifier for amplification of the control voltage.

BRIEF DESCRIPTION OF THE DRAWINGS

The following description of figures of exemplary embodiments may further illustrate and explain the invention. Devices with the same structure and the same effect, respectively, appear with equivalent reference symbols. In so far as circuits or devices correspond to one another in terms of their function in different figures, the description thereof is not repeated for each of the following figures.

DETAILED DESCRIPTION OF THE DRAWINGS

Figure 1:
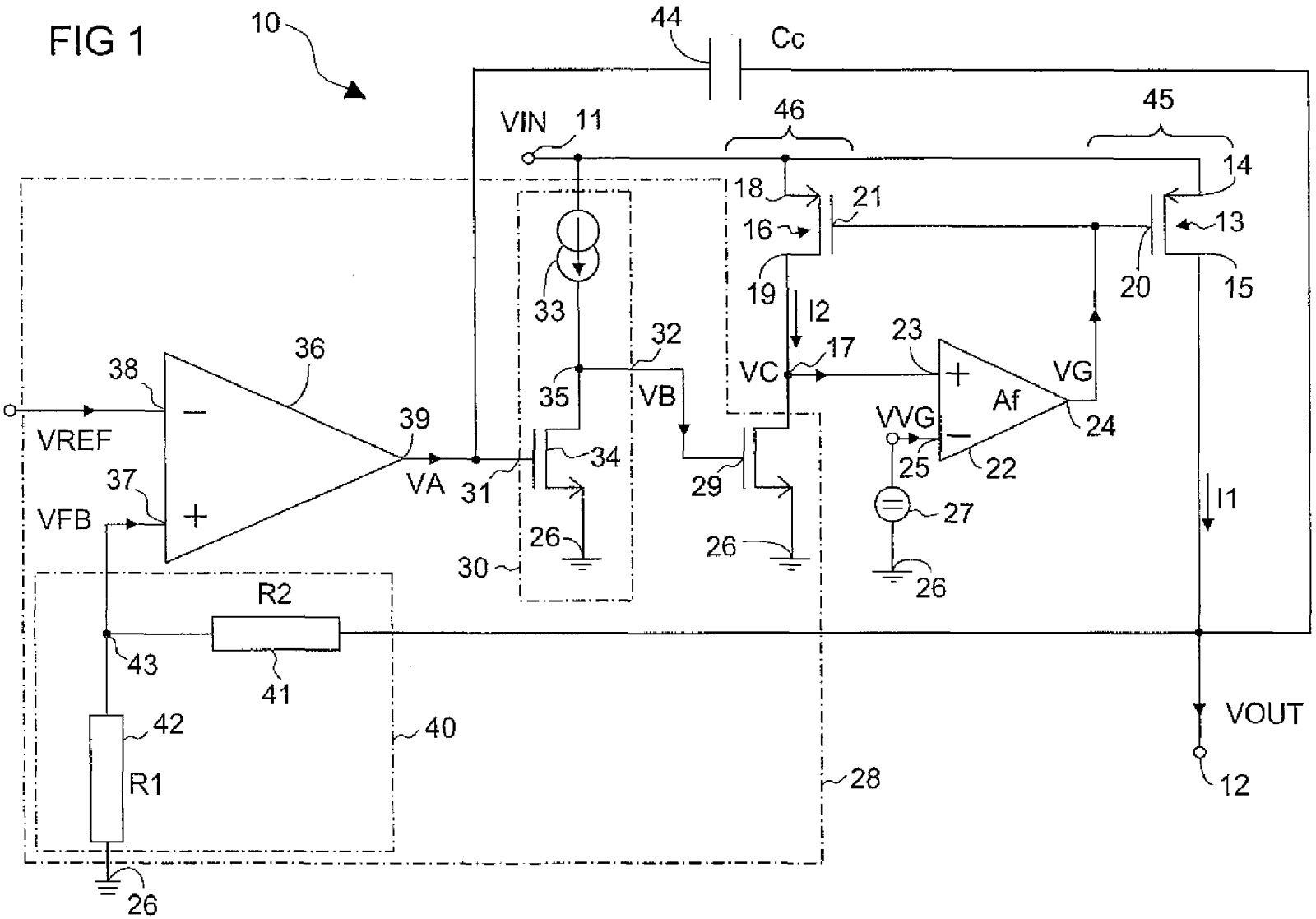
FIG. 1 shows a first exemplary embodiment of a voltage regulator according to the invention.

FIG. 1 shows an exemplary embodiment of a voltage regulator according to the invention. The voltage regulator 10 comprises an input terminal 11 and an output terminal 12. A first transistor 13 couples the input terminal 11 to the output terminal 12. The first transistor 13 comprises a first terminal 14 which is connected to the input terminal 11 and a second terminal 15 which is connected to the output terminal 12. The voltage regulator 10 further comprises a second transistor 16 and a control node 17. A first terminal 18 of the second transistor 16 is connected to the input terminal 11. Furthermore, a second terminal 19 of the second transistor 16 is connected to the control node 17. A control terminal 20 of the first transistor 13 is connected to a control terminal 21 of the second transistor 16.

Additionally, the voltage regulator 10 comprises an amplifier 22 with an input terminal 23 and an output terminal 24. The input terminal 23 of the amplifier 22 is connected to the control node 17. The output terminal 24 of the amplifier 22 is connected to the control terminal 20 of the first transistor 13 and, therefore, also to the control terminal 21 of the second transistor 16. The amplifier 22 also comprises a further input terminal 25. The further input terminal 25 is coupled to a reference potential terminal 26 via a voltage source 27. The input terminal 23 of the amplifier is realized as a non-inverting input terminal, whereas the further input terminal 25 of the amplifier 22 is realized as an inverting input terminal.

Furthermore, the voltage regulator 10 comprises a feedback circuit 28 which couples the output terminal 12 to the control node 17. The feedback circuit 28 comprises a third transistor 29. The third transistor 29 couples the control node 17 to the reference potential terminal 26. A first terminal of the third transistor 29 is connected to the reference potential terminal 26, while a second terminal of the third transistor 29 is connected to the control node 17. A control terminal of the third transistor 29 is coupled to the output terminal 12 via the feedback circuit 28.

Moreover, the feedback circuit 28 comprises a gain stage 30 with an input terminal 31 and an output terminal 32. The output 32 of the gain stage 30 is connected to the control terminal of the third transistor 29. The input terminal 31 of the gain stage 30 is coupled to the output terminal 12 via the feedback circuit 28. The gain stage 30 comprises a current source 33 and a fourth transistor 34 which are arranged in series between the input terminal 11 and the reference potential terminal 26. A gain stage node 35 is arranged between the current source 33 and the fourth transistor 34. The gain stage node 35 is connected to the control terminal of the third transistor 29 via the output terminal 32 of the gain stage 30. The current source 33 couples the input terminal 11 of the voltage converter 10 to the gain stage node 35, while the fourth transistor 34 couples the gain stage node 35 to the reference potential terminal 26. A control terminal of the fourth transistor 34 is connected to the input terminal 31 of the gain stage 30.

Additionally, the feedback circuit 28 comprises a feedback amplifier 36. An output terminal 39 of the feedback amplifier 36 is coupled to the input terminal 31 of the gain stage 30. The feedback amplifier 36 comprises a first and a second input terminal 37, 38. The first input terminal 37 of the feedback amplifier 36 is realized as a non-inverting input terminal, as the second input terminal 38 of the feedback amplifier 36 is realized as an inverting input terminal. The first input terminal 37 of the feedback amplifier 36 is coupled to the output terminal 12 via the feedback circuit 28. The feedback circuit 28 further comprises a voltage divider 40. The voltage divider 40 comprises a first divider resistor 41, a second divider resistor 42 and an output node 43 which is arranged between the first divider resistor 41 and the second divider resistor 42. The voltage divider 40 couples the output terminal 12 to the reference potential terminal 26. The output node 43 is coupled to the first input terminal 37 of the feedback amplifier 36.

Furthermore, the voltage regulator 10 comprises a coupling capacitor 44 which couples the output terminal 12 to the input terminal 31 of the gain stage 30.

A first current path 45 comprises the first transistor 13 and connects the input terminal 11 to the output terminal 12. Similarly, a second current path 46 comprises the second and the third transistors 16, 29 and connects the first input terminal 11 to the reference potential terminal 26.

A supply voltage VIN is supplied to the input terminal 11. A first current I1 flows through the first transistor 13 and, therefore flows from the input terminal 11 to the output terminal 12 via the first current path 45. An output voltage VOUT is provided at the output terminal 12. A second current I2 flows through the second and the third transistors 16, 29 of the second current path 46. A control voltage VC is provided at the control node 17 of the second current path 46. The control voltage VC is applied to the input terminal 23 of amplifier 22. A reference voltage VVG is supplied to the further input terminal 25 of the amplifier 22. The reference voltage VVG is provided by the voltage source 27. The amplifier 22 generates a control terminal voltage VG at its output terminal 24. The control terminal voltage VG is applied to the control terminal 20 of the first transistor 13 and to the control terminal 21 of the second transistor 16. Therefore, the first and the second transistor 13, 16 are controlled by an equal voltage. The first and the second transistors 13, 16 form a current mirror.

The output voltage VOUT is supplied to the voltage divider 40. Thus a feedback voltage VFB is provided at the output node 43 of the voltage divider 40 depending on the output voltage VOUT. The feedback voltage VFB is applied to the first input terminal 37 of the feedback amplifier 36. A feedback reference voltage VREF is provided to the second input terminal 38 of the feedback amplifier 36. The feedback amplifier 36 provides an amplifier output voltage VA at its output 39 depending on a difference of the feedback voltage VFB and the feedback reference voltage VREF. The amplifier output voltage VA is supplied to the input terminal 31 of the gain stage 30 and, therefore, also to the control terminal of the fourth transistor 34. The gain stage 30 amplifies the feedback amplifier output voltage VA and provides a gain stage output voltage VB at its output 32. The gain stage output voltage VB is applied to the control terminal of the third transistor 29. In this way the gain stage output voltage VB controls the second current I2 flowing through the third transistor 29 so that the feedback loop is closed. A change of the output voltage VOUT also influences the amplifier output voltage VA by the coupling capacitor 44. A further feedback loop is closed by the amplifier 22, the second transistor 16 and the control node 17.

The first, second, third and fourth transistors 13, 16, 29, 34 are realized as field-effect transistors. The first, second, third and fourth transistors 13, 16, 29, 34 are preferably designed as metal-oxide-semiconductor field-effect transistors. The first and the second transistors 13, 16 are realized as p-channel field-effect transistors. In one embodiment of the invention, a width to length ratio of the first transistor 13 is larger than a width to length ratio of the second transistor 16. The third and the fourth transistors 29, 34 are designed as n-channel field-effect transistors.

The current source 33 is designed as current mirror, which is not shown. The current source 33 comprises p-channel field-effect transistors.

Since a reference voltage VVG is applied to the further input terminal 25 of the amplifier 22, the control voltage VC at the control node 17, which also is the voltage at the input terminal 23 of the amplifier 22, is approximately equal to the reference voltage VVG. Since the reference voltage VVG is a constant voltage, the voltage at the second terminal 19 of the second transistor 16 is approximately fixed. This is achieved by means of the further feedback loop comprising the amplifier 22.

The reference voltage VVG is independent of the supply voltage VIN. The reference voltage VVG is related to a ground potential of the reference potential terminal 26. The further feedback loop adjusts the control terminal voltage VG so that the second transistor 16 receives approximately the same bias current from the third transistor 29 even after variations of the voltage across the controlled section between the first and the second terminal 18, 19 of the second transistor 16. As a result, the first transistor 13 receives an increasing voltage across its controlled section between the first and the second terminal 14, 15 contemporarily (that means substantially simultaneously) to a decrease of a voltage between the control terminal 20 and the first terminal 14 and vice versa.

The first and the second transistors 13, 16 are advantageously matched devices. A threshold voltage of the first transistor 13 is approximately equal to a threshold voltage of the second transistor 16. Since a voltage between the control terminal 20 and the first terminal 14 of the first transistor 13 and a voltage between the control terminal 21 and the first terminal 18 of the second transistor 16 share the same variations and further on the voltages across the controlled sections of the first and the second transistors 13, 16 share the same variations, an adjustment of the control terminal voltage VG of the second transistor 16 is also effective for the first transistor 13 to exactly counteract variation of the voltage across the controlled sections of the first transistor 13. It is an advantage that the first and the second transistors 13, 16 have the same operating conditions.

In addition, a voltage at the second terminal of the third transistor 29 is biased to a virtual ground of the voltage regulator 10 via the further feedback loop. The reference voltage VVG is advantageously not equal to the potential at the reference potential terminal 26 so that a non-zero voltage is applied to the controlled section of the third transistor 29. Thus approximately no variation of a voltage across the controlled section of the third transistor 29 has an effect on the third transistor 29 after a change of the supply voltage VIN. Therefore, a power supply rejection ratio PSRR at high frequencies which is referred to the input terminal 31 of the gain stage 30 is approximately achieved according to the following equation:

$$PSRR = \frac{\Delta VIN}{\mathrm{gm_pout} * \mathrm{rds_pout} * Af * gmn2 * rds * ggs},$$

wherein ΔVIN is a variation of the value of the supply voltage VIN, gm_pout is a transconductance of the first transistor 13, rds_pout is a first resistance of the controlled section of the first transistor 13, Af is a gain factor of the amplifier 22, gmn2 is a transconductance of the third transistor 29 and ggs is a gain factor of the gain stage 30. An additional resistance rds is given by the parallel circuit of a second resistance rds_mpd which is the resistance of the controlled section of the second transistor 16 and a third resistance rds_mn2 which is the resistance of the controlled section of the third transistor 29. The amplifier 22 advantageously comprises only a small number of transistors. The amplifier 22 can be implemented as a single-stage amplifier.

In an embodiment of the invention in which the third transistor 29 is designed with a length of a channel which is larger than a length of a channel of the second transistor 16, the third resistance rds_mn2 of the controlled section of the third transistor 29 is larger than the second resistance rds_mdp of the controlled section of the second transistor 16 though the additional resistance rds is approximately equal to the second resistance rds_mdp.

The first transistor 13 is advantageously realized as a power metal-oxide semiconductor field-effect transistor. The output stage of the voltage regulator comprises a feedback-based current mirror.

Figure 2:
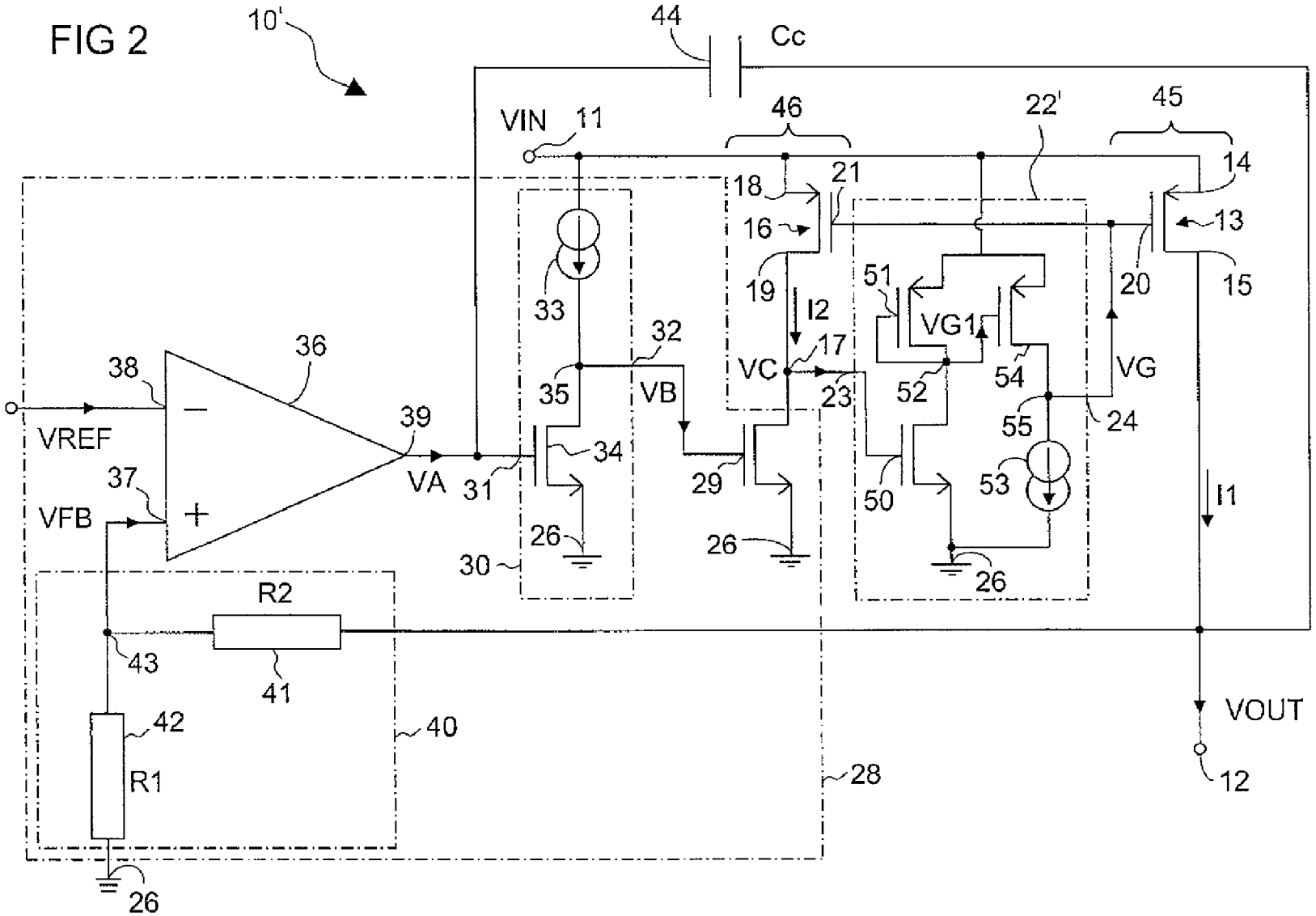
FIG. 2 shows a second exemplary embodiment of a voltage regulator according to the invention.

FIG. 2 shows a further exemplary embodiment of a voltage regulator according to the invention. The voltage regulator of FIG. 2 is a further development of the voltage regulator of FIG. 1. The voltage regulator according to FIG. 2 comprises the first and the second transistors 13, 16 and the feedback circuit 28 which are already described in the description of FIG. 1. The voltage regulator 10' also comprises the amplifier 22' with the input terminal 23 and the output terminal 24.

The amplifier 22' according to FIG. 2 further comprises a first and a second amplifier transistor 50, 51 which are connected in series between the input terminal 11 and the reference potential terminal 26. A control terminal of the first amplifier transistor 50 is connected to the input terminal 23 of the amplifier 22'. A first stage node 52 is arranged between the first and the second amplifier transistors 50, 51. The first amplifier transistor 50 couples the first stage node 52 to the reference potential terminal 26, while the second amplifier transistor 51 couples the first stage node 52 to the input terminal 11. A control terminal of the second amplifier transistor 51 is connected to the first stage node 52 and, therefore, to a terminal of the second amplifier transistor 51. The first stage node 52 is coupled to the output terminal 24 of the amplifier 22'.

Additionally, the amplifier 22' comprises a current generator 53 and a third amplifier transistor 54. The current generator 53 and the third amplifier transistor 54 are connected in series between the input terminal 11 and the reference potential terminal 26. A second stage node 55 is arranged between the current generator 53 and the third amplifier transistor 54. The second stage node 55 is connected to the output terminal 24 of the amplifier 22'. The second stage node 55 is coupled to the input terminal 11 via the third amplifier transistor 54. Furthermore, the second stage node 55 is coupled to the reference potential terminal 26 via the current generator 53. The first, second and third amplifier transistors 50, 51, 54 are realized as field-effect transistors. The first, second and third amplifier transistors 50, 51, 54 are preferably designed as metal-oxide-semiconductor field-effect transistors. Moreover, the first amplifier transistor 50 is realized as an n-channel field-effect transistor. The second and the third amplifier transistors 51, 54 are designed as p-channel field-effect transistors. The current generator 53 is designed as a current mirror, which is not shown. The current generator 53 comprises n-channel field-effect transistors.

Thus the amplifier 22' comprises a first stage with the first and the second amplifier transistors 50, 51 and a second stage with the third amplifier transistor 54 and the current generator 53. The first amplifier transistor 50 represents an input stage of the amplifier 22'. The second and the third amplifier transistors 51, 54 form a current mirror and thus couple the first stage to the second stage of the amplifier 22'. The amplifier 22' is designed as an amplifier with lower power consumption. The amplifier 22' is realized as a single input amplifier.

The control voltage VC is applied to the control terminal of the first amplifier transistor 50 via the input terminal 23 of the amplifier 22'. The first amplifier transistor 50 forms a common source field-effect transistor. A first stage voltage VG1 at the first stage node 52 is applied to the control terminal of the third amplifier transistor 54. The control terminal voltage VG is provided at the second stage node 55. The biasing of the third amplifier transistor 54 is provided by the current generator 53 which acts as a pull down device for the control terminal 20 of the first transistor 13.

The amplifier 22' advantageously achieves a high gain by the use of the first and the second stages. Therefore, an efficient further control loop is realised by the design of the amplifier 22' according to FIG. 2. The amplifier 22' provides a virtual ground to the control node 17 and, therefore, also to the second terminal of the third transistor 29. The virtual ground is tracked to the reference potential terminal 26. The first and the second transistors 13, 16 have an approximately equal tracking capability versus the supply voltage VIN.

It is an advantage of the amplifier 22' that it needs only a small area on a semiconductor body and shows a low power consumption, especially at a light load for the voltage regulator 10'. The current mirror comprising the second and the third amplifier transistors 51, 54 advantageously provides a desired inversion in the signal to drive the control terminal 20 of the first transistor 13 at a high impedance and with a large voltage swing. In addition, a fast response is provided when a load current flowing through the output terminal 12 obtains a high value.

The intrinsic power supply rejection ratio of the amplifier 22' is good since the current mirror comprising the second and the third amplifier transistors 51, 54 inside the amplifier 22' has its drain terminals tracking to the supply voltage VIN.

The voltage regulator 10' achieves a high power supply rejection ratio at direct current (that means at low frequencies). Furthermore, the voltage regulator 10' achieves a high power supply rejection ratio also at high frequency values, for example at 100 kHz. The high power supply rejection ratio is achieved in combination with a low power consumption. The feedback structure of the voltage regulator 10' is capable of rejecting noise and disturbances since they are spectral components which are below the gain bandwidth of the closed loop structure. The disturbance coupled to the output terminal 12 is determined by the means of a transfer function which depends on the architecture of the voltage regulator 10'. The loop gain of the feedback structure of the voltage regulator 10' at a given frequency is responsible how strong the disturbances at a given frequency are rejected. It is an advantage of the voltage regulator 10' that it achieves a high symmetry of the voltage across the controlled section of the first transistor 13 and the voltage across the controlled section of the second transistor 16. This leads to a high power supply rejection ratio in a large frequency range.

In an alternative embodiment, which is not shown, the current generator 53 can be coupled to the control terminal of the first amplifier transistor 50. The amplifier provides a full class AB drive for the control terminal of the first transistor 13, improving speed in a response to a load transient.

In an alternative embodiment, which is not shown, the first and second transistors 13, 16 are n-channel field-effect transistors. The third and the fourth transistors 29, 34 are p-channel field-effect transistors, thus the voltage regulator is designed as a negative low dropout regulator. In case of a negative low dropout regulator, the first amplifier transistor 50 is implemented as a p-channel field-effect transistor and the second and the third amplifier transistors 51, 54 are designed as n-channel field-effect transistors.

The current generator 53 comprises p-channel field-effect transistors.

Figure 3:
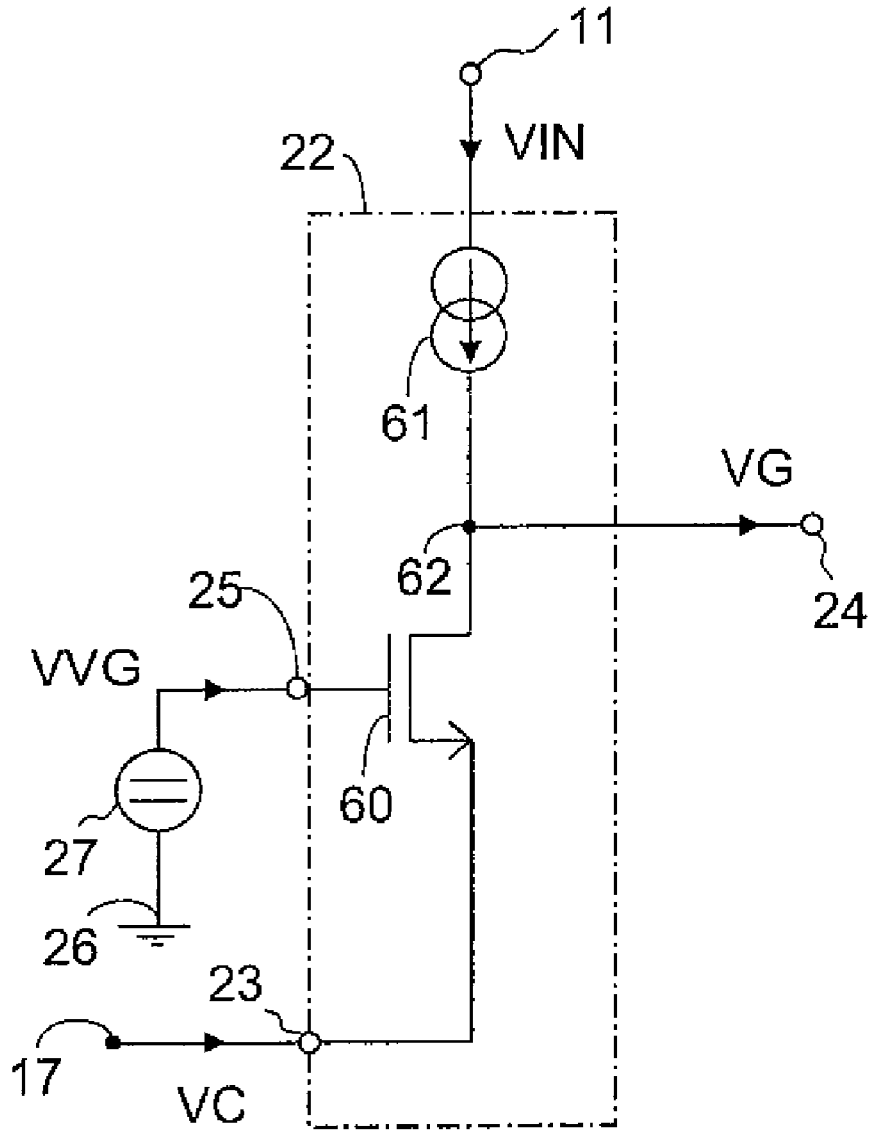
FIG. 3 shows an exemplary embodiment of an amplifier of a voltage regulator according to the invention.

FIG. 3 shows an exemplary embodiment of an amplifier that can be inserted in the voltage regulator of FIG. 1 according to the invention. The amplifier 22 comprises an amplification transistor 60 coupling the input terminal 23 of the amplifier 22 to an amplifier node 62. The amplifier node 62 is coupled to the output terminal 24 of the amplifier 22.

Thus a controlled path of the amplification transistor 60 couples the control node 17 to the control terminal 20 of the first transistor 13 and to the control terminal 21 of the second transistor 16. The further input terminal 25 of the amplifier 22 is connected to a control terminal of the amplification transistor 60. The amplification transistor 60 is implemented as a metal-oxide-semiconductor field-effect transistors. The amplification transistor 60 is realized as an n-channel field-effect transistor. Further on, the amplifier 22 comprises a current generator 61. The current generator 61 is connected to the amplifier node 62. The current generator 61 is implemented as a pull-up current generator. Thus the current generator 61 is switched between the input terminal 11 and the amplifier node 62.

The reference voltage VVG is applied to the control terminal of the amplification transistor 60. The control terminal voltage VG is generated by amplification of the control voltage VC in a non-inverting way. The control terminal voltage VG depends on the control voltage VC and the reference voltage VVG.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. A voltage regulator, comprising:

an input terminal to receive a supply voltage;

an output terminal to provide an output voltage;

a first transistor which couples the input terminal of the voltage regulator to the output terminal of the voltage regulator;

a second transistor, the first and the second transistors forming a current mirror structure;

a control node which is coupled to the input terminal of the voltage regulator via the second transistor and which is coupled to the output terminal of the voltage regulator via a feedback circuit, the feedback circuit forming a control loop and comprising a feedback amplifier for comparing a feedback voltage derived from the output voltage to a feedback reference voltage; and an amplifier with an input terminal which is coupled to the control node and with an output terminal which is coupled to a control terminal of the second transistor.

2. The voltage regulator according to claim 1, wherein the control terminal of the second transistor is directly connected to a control terminal of the first transistor and to the output terminal of the amplifier.

3. The voltage regulator according to claim 1, the feedback circuit comprising a third transistor which couples the control node to a reference potential terminal.

4. The voltage regulator according to claim 3, the feedback circuit further comprising a gain stage with an input terminal which is coupled to the output terminal of the voltage regulator, and an output terminal which is coupled to a control terminal of the third transistor for forming the control loop.

5. The voltage regulator according to claim 4, wherein the gain stage comprises a current source and a fourth transistor which are connected in series between the input terminal of the voltage regulator and the reference potential terminal, wherein the input terminal of the gain stage is connected to a control terminal of the fourth transistor, and wherein a gain stage node between the fourth transistor and the current source is connected to the output terminal of the gain stage.

6. The voltage regulator according to claim 4, comprising a coupling capacitor which couples the output terminal of the voltage regulator to the input terminal of the gain stage.

7. The voltage regulator according to claim 4, the feedback circuit further comprising a voltage divider which couples the output terminal of the voltage regulator to the reference potential terminal, wherein the feedback amplifier comprises:

a first input terminal which is coupled to an output node of the voltage divider, a second input terminal to receive the feedback reference voltage, and an output terminal which is coupled to the input terminal of the gain stage.

8. The voltage regulator according to claim 1, wherein the first and the second transistors each comprise a metal-oxide-semiconductor field-effect transistor respectively.

9. The voltage regulator according to claim 1, wherein the amplifier comprises a further input terminal to which a reference voltage is provided.

10. The voltage regulator according to claim 1, wherein the amplifier comprises a first and a second amplifier transistor which are connected in series between the input terminal of the voltage regulator and a reference potential terminal, wherein a control terminal of the first amplifier transistor is connected to the input terminal of the amplifier, a control terminal of the second amplifier transistor is connected to a first stage node between the first and the second amplifier transistor, and the first stage node is coupled to the output terminal of the amplifier.

11. The voltage regulator according to claim 10, wherein the amplifier further comprises a current generator and a third amplifier transistor which are connected in series between the input terminal of the voltage regulator and the reference potential terminal, wherein the first stage node is coupled to a control terminal of the third amplifier transistor, and wherein a second stage node between the current generator and the third amplifier transistor is coupled to the output terminal of the amplifier.

12. A method for voltage regulation, comprising:

providing a first current path comprising a first transistor and a second current path comprising a second transistor, supplying a supply voltage to the first and the second current path, providing an output voltage at the first current path, mirroring a first current in the first current path to a second current in the second current path, in a first control loop, generating a feedback voltage depending on the output voltage, in the first control loop, controlling the second current path depending on a comparison of the feedback voltage to a feedback reference voltage, providing a further control loop comprising an amplifier with an input coupled to the second current path and with an output coupled to control terminals of the first and the second transistor, in the further control loop, by means of the amplifier, generating a control terminal voltage by amplification of a control voltage which is provided by the second current path, and providing the control terminal voltage to the control terminals of the first and the second transistor.

* * * * *